US008485231B2

(12) United States Patent
Young

(10) Patent No.: US 8,485,231 B2
(45) Date of Patent: Jul. 16, 2013

(54) METHOD AND APPARATUS FOR DISPENSING LIQUID MEDICINE

(75) Inventor: David Young, Syracuse, NY (US)

(73) Assignee: Tessy Plastics Corporation, Elbridge, NY (US)

( * ) Notice: Subject to any disclaimer, the term of this patent is extended or adjusted under 35 U.S.C. 154(b) by 0 days.

(21) Appl. No.: 13/545,245

(22) Filed: Jul. 10, 2012

(65) Prior Publication Data

US 2013/0014856 A1 Jan. 17, 2013

Related U.S. Application Data

(60) Provisional application No. 61/506,407, filed on Jul. 11, 2011.

(51) Int. Cl.
*B65B 1/04* (2006.01)

(52) U.S. Cl.
USPC ..... 141/2; 141/27; 141/329; 604/905; 604/415; 215/247

(58) Field of Classification Search
USPC ..... 141/2, 18, 27, 329–330, 113; 604/411, 604/415, 905; 215/236, 247, 249, 316
See application file for complete search history.

(56) References Cited

U.S. PATENT DOCUMENTS

| | | | | |
|---|---|---|---|---|
| 2,388,634 | A | 11/1945 | Woody | |
| 3,558,022 | A * | 1/1971 | Zytko | 222/490 |
| 4,132,334 | A * | 1/1979 | Danks | 222/490 |
| 4,173,858 | A * | 11/1979 | Cassia | 53/471 |
| 4,230,112 | A | 10/1980 | Smith | |
| 5,060,812 | A | 10/1991 | Ogle | |
| 5,287,898 | A * | 2/1994 | Falb et al. | 141/329 |
| 5,297,599 | A * | 3/1994 | Bucheli | 141/329 |
| RE35,167 | E | 3/1996 | Mouchawar | |
| 5,598,939 | A | 2/1997 | Watson | |
| 6,752,965 | B2 | 6/2004 | Levy | |
| 7,473,399 | B2 | 1/2009 | Dehmer | |
| 8,196,614 | B2 * | 6/2012 | Kriheli | 141/5 |
| 2004/0149287 | A1 | 8/2004 | Namey | |
| 2006/0006202 | A1 | 1/2006 | Stull | |
| 2009/0004064 | A1 | 1/2009 | Liu | |
| 2009/0081407 | A1 | 3/2009 | Giraud | |
| 2009/0120528 | A1 * | 5/2009 | Fisher et al. | 141/1 |
| 2010/0024914 | A1 * | 2/2010 | Baker | 141/27 |
| 2010/0327010 | A1 | 12/2010 | Manera | |
| 2011/0130740 | A1 | 6/2011 | Levy | |
| 2011/0147240 | A1 * | 6/2011 | Kim | 206/219 |

* cited by examiner

*Primary Examiner* — Timothy L Maust
*Assistant Examiner* — Timothy Kelly
(74) *Attorney, Agent, or Firm* — Hiscock & Barclay, LLP; Peter J. Mikesell

(57) ABSTRACT

Disclosed in this specification is a medicine container with a flexible flap covering the opening of the container. The opening is closed by the flexible flap when the flexible flap is in a resting position and the opening is opened when the flexible flap is in a flexed position. A hand-operated plunger is equipped with an end configured to mate with the opening such that a seal is established between the plunger and the opening. The plunger is shaped to apply a force to the flexible flap, thereby operating the flexible flap.

12 Claims, 7 Drawing Sheets

METHOD AND APPARATUS FOR DISPENSING LIQUID MEDICINE

CROSS-REFERENCE TO RELATED APPLICATION

This application claims priority to and the benefit of U.S. provisional patent application Ser. No. 61/506,407, filed Jul. 11, 2011, which application is incorporated herein by reference in its entirety.

FIELD OF THE INVENTION

This invention relates, in one embodiment, to a method and apparatus for dispensing liquid medicine from a container while preventing inadvertent access to the contents of the container.

BACKGROUND

Liquid medicines are often dispensed from a source container using a simple plunger. The plunger helps the user measure a predetermined quantity of the liquid for subsequent transfer into, for example, the mouth of a small child. Unfortunately, this prior art transfer method leaves the source container somewhat vulnerable to contamination during the transfer process. Bacteria or other undesirable contaminants may fall into the source container and spoil all subsequent uses of the medicine. Additionally, the contents of the source container may be undesirably accessed by other individuals, such as small children.

Therefore, an improved method and apparatus for dispensing liquid medicine is desired.

The discussion above is merely provided for general background information and is not intended to be used as an aid in determining the scope of the claimed subject matter.

SUMMARY OF THE INVENTION

The invention comprises, in one form thereof, a medicine container with a flexible flap covering the opening of the container. The opening is closed by the flexible flap when the flexible flap is in a resting position and the opening is opened when the flexible flap is in a flexed position. A hand-operated plunger is equipped with an end configured to mate with the opening such that a seal is established between the plunger and the opening. The plunger is shaped to apply a force to the flexible flap, thereby operating the flexible flap.

In a first exemplary embodiment, an apparatus for dispensing liquid medicine from a container is disclosed. The apparatus comprises an adapter with an opening, formed by an inner sidewall, and an outer sidewall surrounding the inner sidewall. The outer sidewall is configured to be disposed in the mouth of the container. A flexible flap is disposed at the distal end of the inner sidewall such that the liquid medicine in the container cannot flow through the opening when the flexible flap is in a resting position, yet the liquid medicine can flow through the opening when the flexible flap is in a flexed position.

In a second exemplary embodiment, an assembly for dispensing liquid medicine from a container is disclosed. The assembly comprises an adapter with an opening, formed by an inner sidewall, and an outer sidewall surrounding the inner sidewall. The outer sidewall is configured to be disposed in the mouth of the container. A flexible flap is disposed at the distal end of the inner sidewall such that the liquid medicine in the container cannot flow through the opening when the flexible flap is in a resting position, yet the liquid medicine can flow through the opening when the flexible flap is in a flexed position. A plunger is configured to mate with the opening such that a seal is established between the plunger and the opening when the plunger id disposed in the opening. The plunger is shaped to apply a force to the flexible flap to cause the flexible flap to adopt the flexed position.

In a third exemplary embodiment, a method for dispensing medicine from a container is disclosed. The method comprises the steps of obtaining an assembly for dispensing liquid medicine. The assembly comprises an adapter with an opening, formed by an inner sidewall, and an outer sidewall surrounding the inner sidewall. The outer sidewall is configured to be disposed in the mouth of the container. A flexible flap is disposed at the distal end of the inner sidewall such that the liquid medicine in the container cannot flow through the opening when the flexible flap is in a resting position, yet the liquid medicine can flow through the opening when the flexible flap is in a flexed position. A plunger is configured to mate with the opening such that a seal is established between the plunger and the opening when the plunger id disposed in the opening. The plunger is shaped to apply a force to the flexible flap to cause the flexible flap to adopt the flexed position. The plunger is placed in the opening and a force is applied to the flexible flap to cause the flexible flap to be ajar. The plunger is operated to withdraw a predetermined quantity of the liquid medicine. The plunger is removed from the opening which causes the flexible flap to close.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
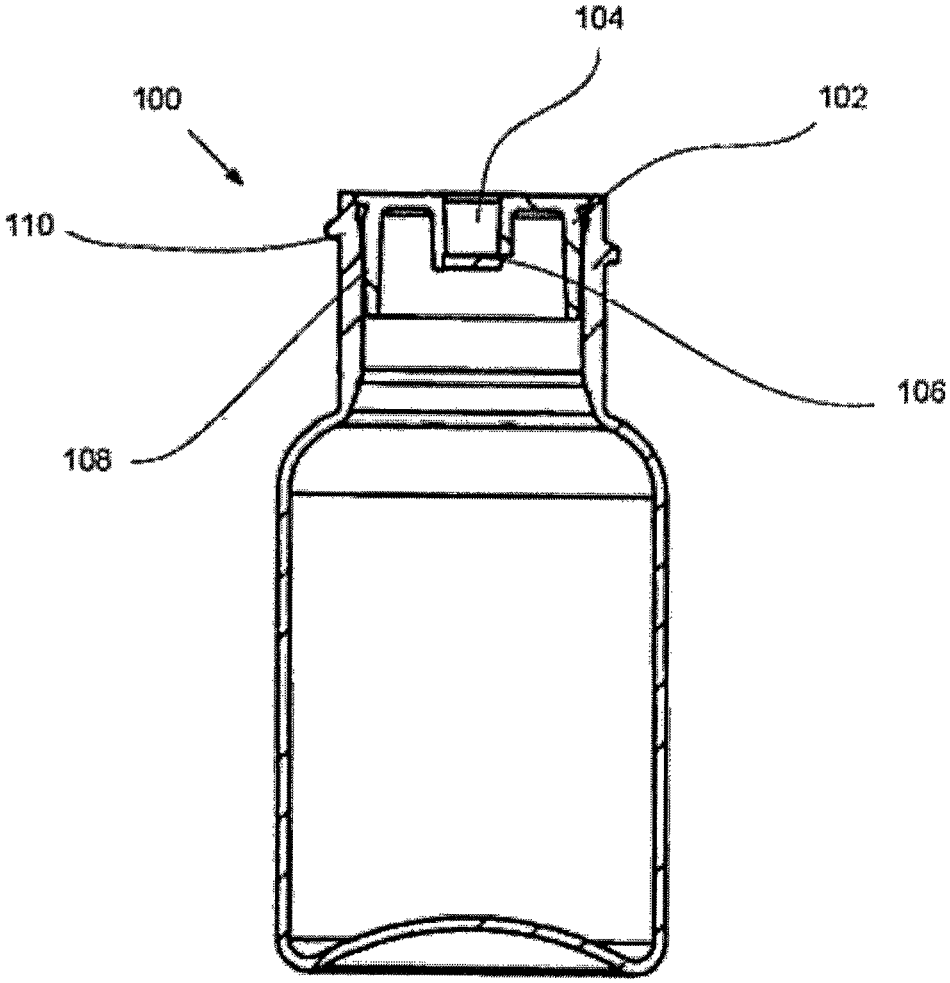
FIG. 1 is a cross-sectional side view of one container of the invention.
Figure 7:
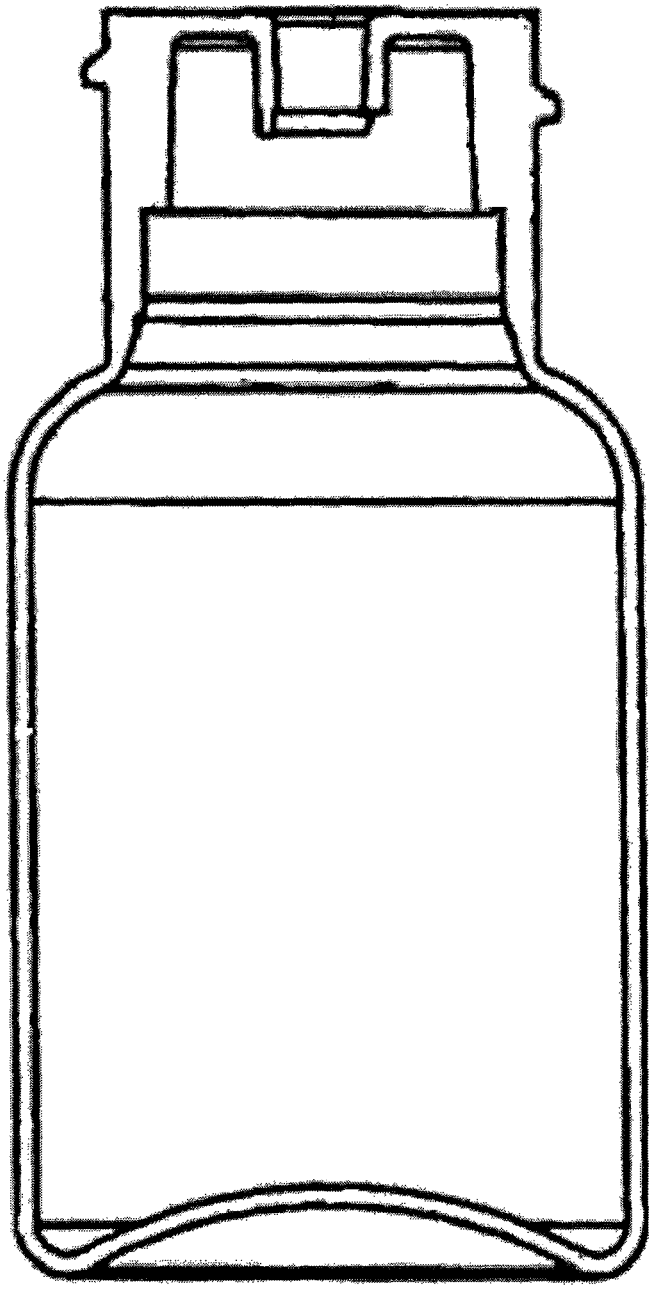

Referring to FIG. 1, a cross-sectional side view of a medicine container 100 is depicted. The container 100 includes an adaptor 102 which has an opening 104. The adapter 102 includes an outer sidewall 108 that securely attaches to a mouth 110 of the container 100. In one embodiment, the container 100 and the adaptor 102 are formed as one piece (i.e., they are monolithic). See FIG. 7. In another embodiment, the adaptor 102 and the container 100 are formed separately (i.e., they are discrete units) and are configured to securely mate with one another to establish a liquid-tight seal that will reveal any tampering. For example, the two components may be formed of polymeric resins and are sealed together by thermally melting the components until they bond. The opening 104 of the adapter 102 terminates in a flexible flap 106. When the adapter 102 is sealed with the container 100, the flexible flap 106 is disposed within the container 100 and opens toward the inside of the container 100 when a downward force is applied.

Figure 2A:
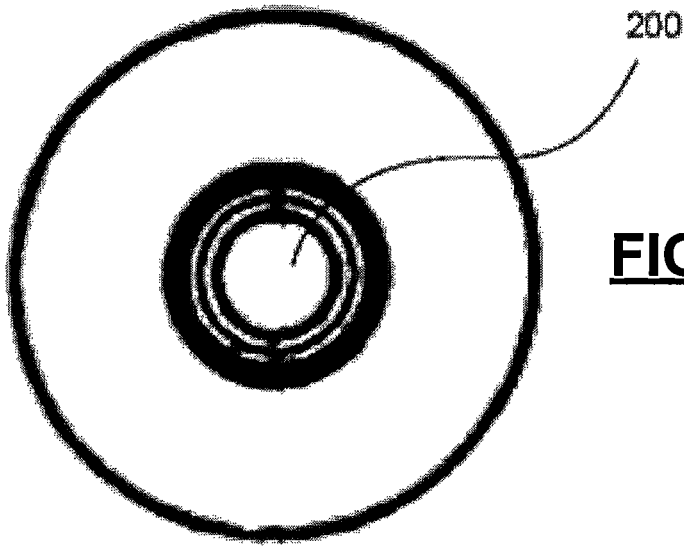
FIG. 2A and FIG. 2B are top and cross-sectional side views, respectively, of one adapter of the invention.
Figure 2B:
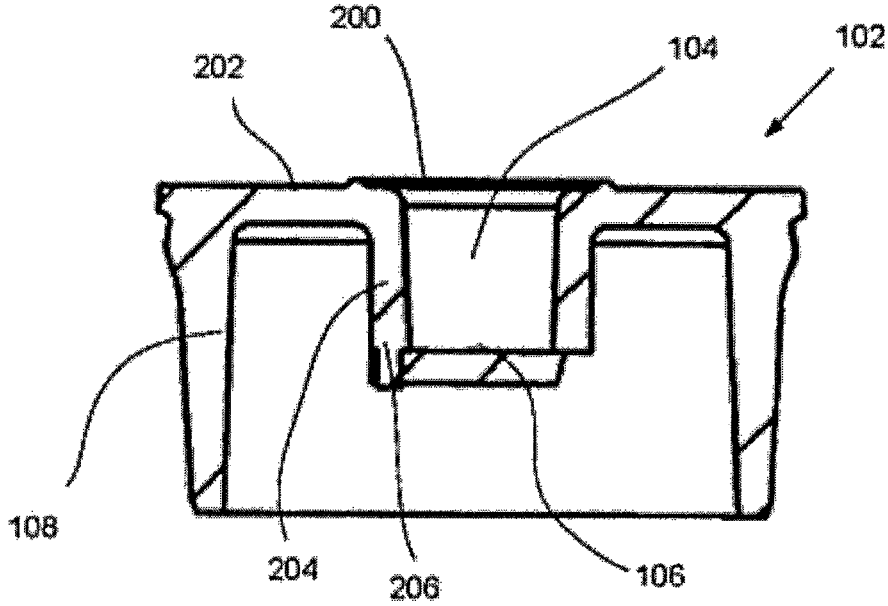

FIG. 2A and FIG. 2B are top and cross-sectional side views, respectively, of the adapter 102. The opening 104 includes a first frangible seal 200 that protects the flexible flap 106 such that it is necessary to break the first frangible seal 200 to access the flexible flap 106. The flexible flap 106 is attached to the adaptor 102 at the inner sidewall 204, which runs substantially parallel to outer sidewall 108. The two sidewalls, 108 and 204, are connected at their upper ends by a top 202. In one embodiment, the outer sidewall 108, the top 202 and the inner sidewall 204 are monolithic and formed of the same material. Any conventional material can be used to form the sidewalls 108, 204, and top 202, including a polymeric resin such as high density polyethylene. Other suitable materials would be apparent to those skilled in the art.

The flexible flap 106 is flexibly, but permanently, attached to one or more points 206 of inner sidewall 204 (e.g., a distal end of the inner sidewall 204) to permit the flexible flap 106 to open upon application of a downward force. FIG. 2B depicts the flexible flap 106 in its resting (closed) state. Upon application of a downward force, the flexible flap 106 adopts a flexed state that leaves the flexible flap 106 ajar. In one embodiment, the flexible flap 106 is formed of a polymeric resin that has a composition unlike that of the inner sidewall 204 (i.e., a dissimilar resin is used). In one embodiment, the resin of the flexible flap 106 is more flexible than the relatively rigid resin of sidewall 204. The resin that forms the flexible flap 106 is resilient such that is returns to its resting position once the downward force is removed, thereby re-sealing the opening 104.

In one embodiment, a two-shot fabrication method is used to form the adaptor 102. In the first shot, the flexible flap 106 is formed from a first resin. In the second shot, the outer sidewall 108, top 202 and inner sidewall 204 are formed from a second resin. The flexible flap 106 is then permanently attached to the inner sidewall 204 at the point 206 by a melting step. In one embodiment, a second frangible seal is also formed about the remaining perimeter of the flexible flap 106. The first and second resins may be selected such that they have different melting points. For example, the melting points may differ by 25° C. or more.

Figure 3:
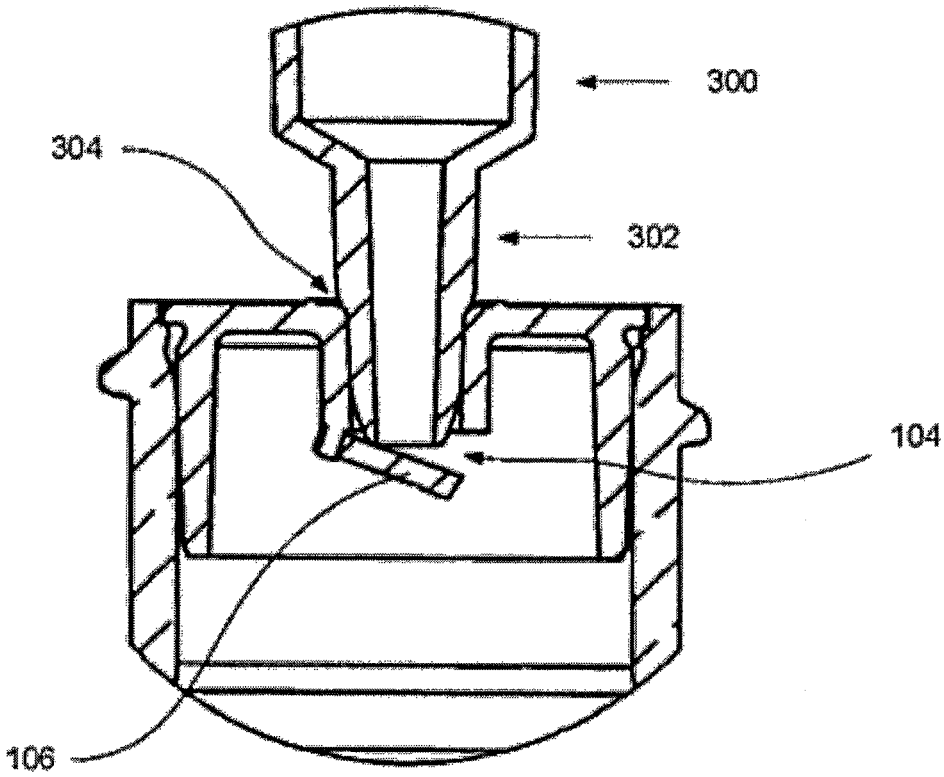
FIG. 3 is a close-up cross-sectional view of the flexible flap of the invention while it is ajar.

FIG. 3 is a close-up cross-sectional view of the flexible flap 106 as plunger 300 applies a downward force to open the flexible flap 106. In those embodiments which have a first frangible seal 200, the end 302 of the plunger 300 breaks the first frangible seal 200 with the first use of the plunger. In this fashion, the first frangible seal 200 provides a visually apparent tamper-evident seal. Similarly, in those embodiments where the perimeter of the flexible flap 106 is sealed to the inner sidewall 204 with a second frangible seal, the first use of the container breaks the second frangible seal as well. Even after the second frangible seal is broken, returning the flexible flap 106 to its resting state partially restores the second frangible seal and reduces the volume of liquid that may inadvertently be emitted. The end 302 of the plunger 300 is configured to mate with the corresponding shape of the opening 104 to establish a seal 304 between the plunger end 302 and the opening 104.

Figure 4:
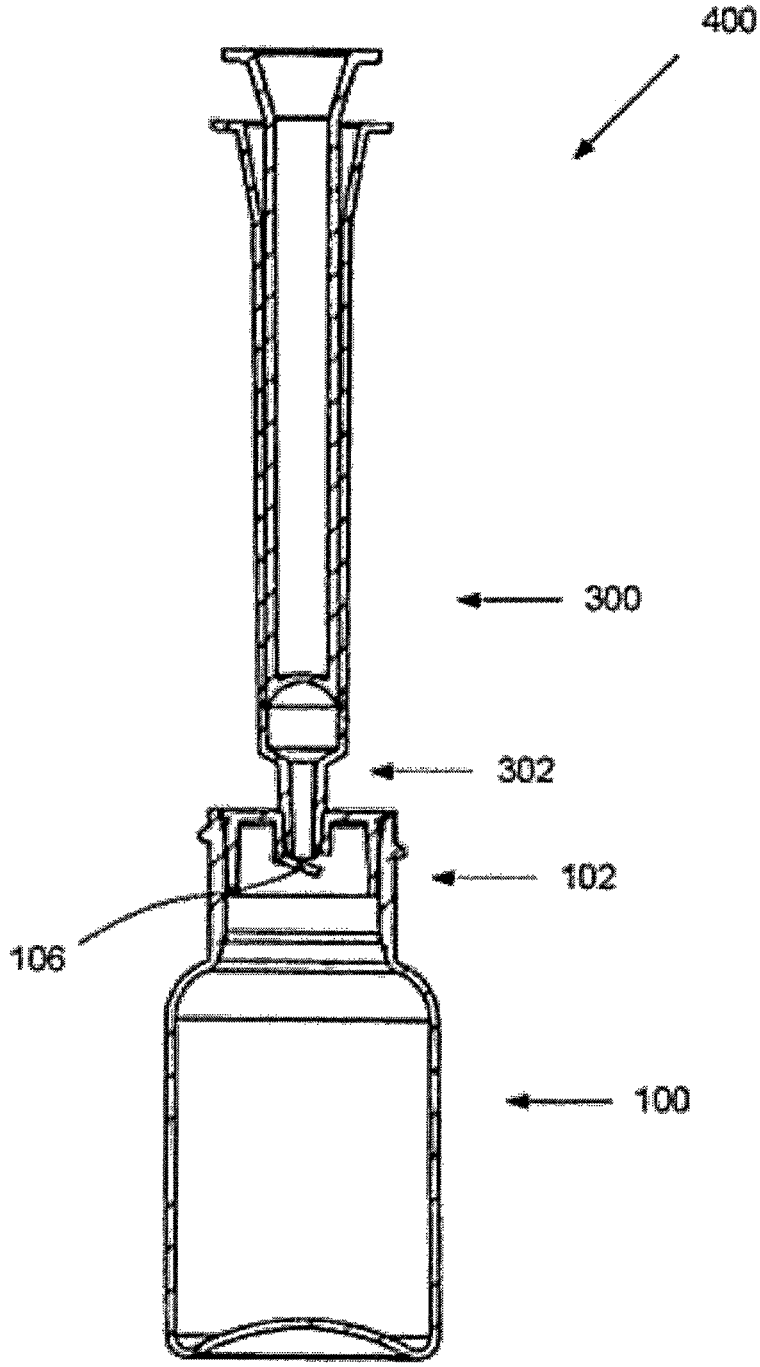
FIG. 4 is a full cross-sectional view of the flexible flap of the invention while it is ajar.

FIG. 4 is a full cross-sectional view of the flexible flap 106 while it is ajar. FIG. 4 shows an assembly 400 that includes both the container 100, the adapter 102 as well as the plunger 300 whose end 302 is configured to mate with the opening 104 of the adapter 102. As shown in FIG. 4, the flexible flap 106 is ajar, thereby permitting the contents of the container 100 to be withdrawn by operating the plunger 300. After a predetermined quantity of medicine is removed from the container 100, the plunger 300 is removed and the flexible flap 106 returns to its resting (closed) position. This re-establishes the seal and protects the contents of container 100 from contamination. A certain level of skill is required to operate the plunger 300 in conjunction with the adapter 102. Typically, small children lack sufficient skill. The system described herein therefore provides a child-resistant seal. Unlike conventional child-resistant seals, the current system can more easily be operated by individuals with impairments, such as arthritis or other similar conditions.

Figure 5:
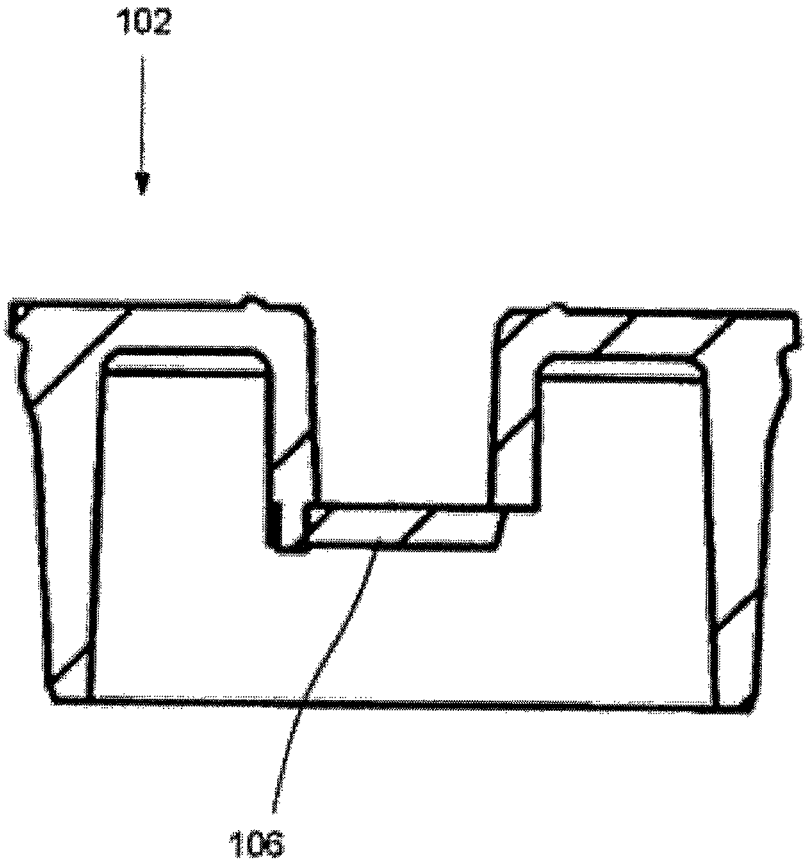
FIG. 5 is a close-up cross-sectional view of the flexible flap of the invention while it is in a resting (closed) state.

FIG. 5 is a close-up cross-sectional view of the flexible flap 106 while it is in a resting (closed) state. The frangible seal 200 (see FIG. 2B) has been broken and is no longer present.

Figure 6:
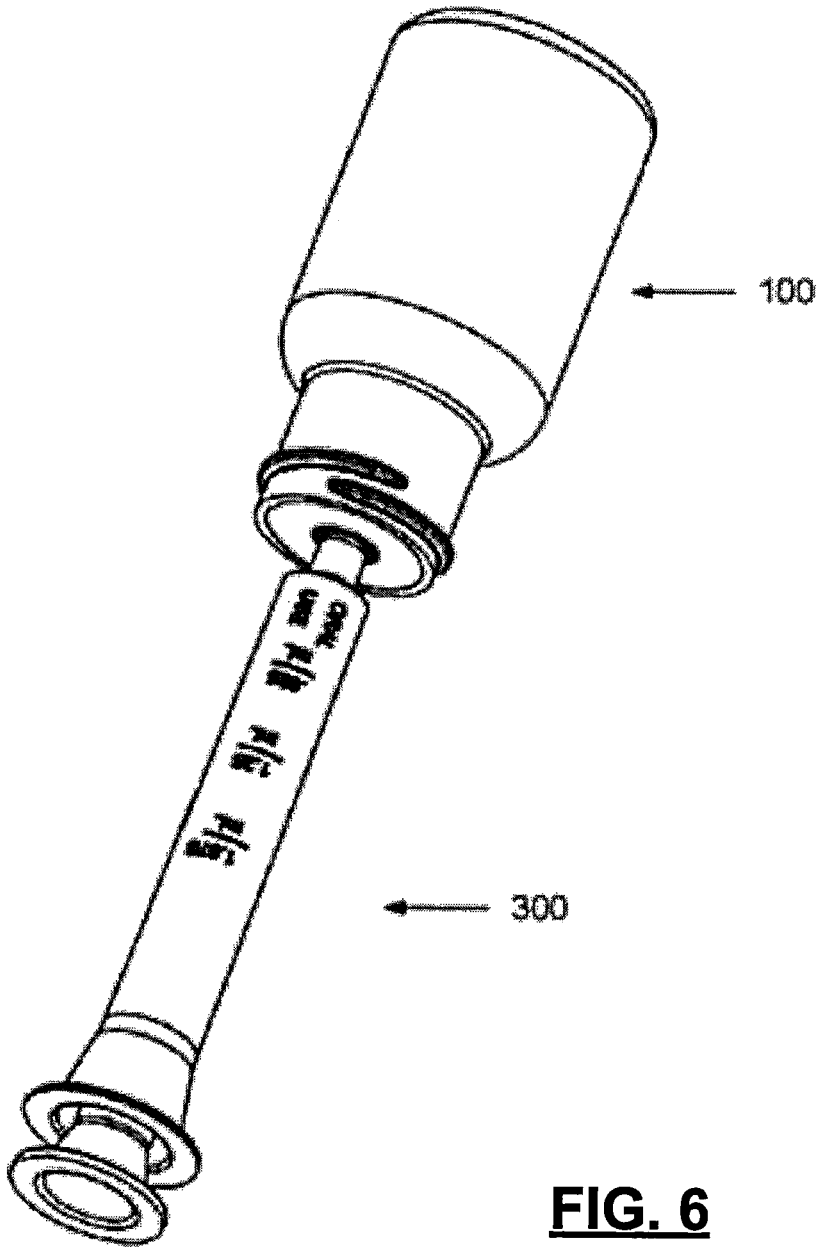
FIG. 6 is a perspective view of the plunger and container in an inverted state and FIG. 7 is a cross-sectional side view of one container of the invention.

In the embodiment depicted in FIG. 6, the container 100 and the plunger 300 are inverted after the seal 304 has been established and the flexible flap 106 is ajar. Since the opening 104 and the end 302 of the plunger are specifically configured to mate, the seal 304 is liquid-tight, such that the container 100 and the plunger 300 can be inverted without spilling the liquid contents of container 100. This assists in the removal of liquid medicine from container 100. The plunger 300 and the container 100 are then returned to an upright position prior to removing the plunger 300 from the opening 104 and permitting the flexible flap 106 to return to its resting (closed) state.

While the invention has been described with reference to certain embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. An apparatus for dispensing liquid medicine from a container, the apparatus comprising:

an adapter comprising:

an opening formed by an inner sidewall, the opening comprising a perimeter, and an outer sidewall surrounding the inner sidewall, the outer sidewall configured to be disposed in the mouth of the container; and a flap disposed at the opening of the inner sidewall;

wherein the adapter comprises a first polymeric compound and the flap comprises a second polymeric compound, different than the first polymeric compound;

wherein the flap is flexibly attached to the opening at a permanent, flexible point of attachment along the perimeter of the opening with the perimeter's remaining circumference forming a frangible seal between the first and second polymeric compounds.

2. The apparatus as recited in claim 1, wherein the opening further includes another frangible seal at a proximal end of the inner sidewall opposite the opening.

3. The apparatus as recited in claim 1, wherein the first polymeric compound and the second polymeric compound have at least a 25° C. difference in melting points.

4. The apparatus as recited in claim 1, wherein the flap is disposed within the container and opens toward the inside of the container when a force is applied.

5. An assembly for dispensing liquid medicine from a container, the assembly comprising:

an adapter comprising an opening formed by an inner sidewall, the opening comprising a perimeter, and an outer sidewall surrounding the inner sidewall, the outer sidewall configured to be disposed in the mouth of the container; and a flap disposed at the opening of the inner sidewall wherein the adapter comprises a first polymeric compound and the flap comprises a second polymeric compound, different than the first polymeric compound;

wherein the flap is flexibly attached to the opening at a permanent, flexible point of attachment along the perimeter of the opening with the perimeter's remaining circumference forming a frangible seal between the first and second polymeric compounds;

a plunger with an end configured to mate with the opening such that a seal is established between the plunger and the opening when the plunger is disposed in the opening, the end of the plunger being shaped to apply a force to the flap when the plunger is disposed in the opening, the flap being in the resting position when no force is applied to the flap and in the flexed position when force is applied to the flap.

6. The assembly as recited in claim 5, wherein the adapter and the container are monolithic.

7. The assembly as recited in claim 5, wherein the adapter and the container are discrete units.

8. The assembly as recited in claim 5, wherein the flap is disposed within the container and opens toward the inside of the container when the force is applied.

9. A method for dispensing medicine from a container comprising the steps of:

obtaining a medicine dispensing assembly comprising an adapter comprising:

an opening formed by an inner sidewall, the opening comprising a perimeter, an outer sidewall surrounding the inner sidewall, the outer sidewall configured to be disposed in the mouth of the container; and a flap disposed at the opening of the inner sidewall;

wherein the adapter comprises a first polymeric compound and the flap comprises a second polymeric compound, different than the first polymeric compound;

wherein the flap is flexibly attached to the opening at a permanent, flexible point of attachment along the perimeter of the opening with the perimeter's remaining circumference forming a frangible seal between the first and second polymeric compounds;

a plunger with an end configured to mate with the opening such that a seal is established between the plunger and the opening when the plunger is disposed in the opening, the end of the plunger being shaped to apply a force to the flap when the plunger is disposed in the opening, the flap being in the resting position when no force is applied to the flap and in the flexed position when force is applied to the flap, wherein a liquid medicine is disposed within the container;

placing the plunger in the opening such that force is applied to the flap, thereby causing the flap to be ajar;

operating the plunger to withdraw a predetermined quantity of the liquid medicine from within the container while the flap is ajar, thereby producing a filled plunger; and removing the filled plunger from the opening, thereby causing the flap to close.

10. The method as recited in claim 9, further comprising the step of establishing a liquid-tight seal between the plunger and the opening during the step of placing the plunger in the opening.

11. The method as recited in claim 10, further comprising the steps of:

inverting the container prior to the step of operating the plunger; and restoring the container to an upright position prior to the step of removing the filled plunger.

12. The method as recited in claim 9 wherein, during a first use of the container, the step of placing the plunger in the opening breaks the frangible seal between the first and second polymeric compounds.

* * * * *